US010672367B2

(12) United States Patent
Saeed et al.

(10) Patent No.: US 10,672,367 B2
(45) Date of Patent: Jun. 2, 2020

(54) PROVIDING DATA TO A DISPLAY IN DATA PROCESSING SYSTEMS

(71) Applicant: ARM Limited, Cambridge (GB)

(72) Inventors: Sharjeel Saeed, Cambridge (GB); Jayavarapu Srinivasa Rao, Cambridge (GB); Ozgur Ozkurt, Cambridge (GB); Daren Croxford, Cambridge (GB)

(73) Assignee: Arm Limited, Cambridge (GB)

( * ) Notice: Subject to any disclaimer, the term of this patent is extended or adjusted under 35 U.S.C. 154(b) by 3 days.

(21) Appl. No.: 15/640,780

(22) Filed: Jul. 3, 2017

(65) Prior Publication Data

US 2019/0005924 A1 Jan. 3, 2019

(51) Int. Cl.

| | |
|---|---|
| ***G09G 5/395*** | (2006.01) |
| ***G09G 5/393*** | (2006.01) |
| ***G09G 5/36*** | (2006.01) |
| ***G09G 3/00*** | (2006.01) |
| ***G09G 5/397*** | (2006.01) |
| ***G09G 5/00*** | (2006.01) |
| ***G09G 3/20*** | (2006.01) |

(52) U.S. Cl.

CPC ..... *G09G 5/395* (2013.01); *G09G 3/002* (2013.01); *G09G 3/2096* (2013.01); *G09G 5/006* (2013.01); *G09G 5/363* (2013.01); *G09G 5/393* (2013.01); *G09G 5/397* (2013.01); *G09G 2340/045* (2013.01); *G09G 2340/0442* (2013.01); *G09G 2360/02* (2013.01); *G09G 2360/08* (2013.01); *G09G 2360/122* (2013.01)

(58) Field of Classification Search

CPC ..... G06T 1/60

See application file for complete search history.

(56) References Cited

U.S. PATENT DOCUMENTS

| | | | | |
|---|---|---|---|---|
| 5,068,648 | A * | 11/1991 | Chiba | G09G 5/39 345/556 |
| 5,387,947 | A * | 2/1995 | Shin | H04N 5/145 348/699 |
| 6,195,204 | B1 * | 2/2001 | Nalwa | G02B 27/1066 348/36 |
| 7,671,865 | B2 * | 3/2010 | Willis | G06F 12/1027 345/545 |
| 2003/0236946 | A1 * | 12/2003 | Greubel | G06F 5/065 711/118 |
| 2007/0182748 | A1 * | 8/2007 | Woo | G06T 15/005 345/506 |

(Continued)

*Primary Examiner* — Phong X Nguyen

(74) *Attorney, Agent, or Firm* — Vierra Magen Marcus LLP

(57) ABSTRACT

A method of operating a data processing system is disclosed for a data processing system that comprises a display and a display controller. The method comprises the display controller providing to the display data for an output surface to be displayed, storing the data in a memory of the display, and the display reading the data from the memory and displaying the output surface. The method further comprises the display controller indicating to the display a particular memory address of the memory, and the display using the indication to control the reading of data from the memory. The display controller may provide to the display image data for one or more sub-regions of the output surface that were not present in a previous version of the output surface.

18 Claims, 5 Drawing Sheets

(56) References Cited

U.S. PATENT DOCUMENTS

| | | | | |
|---|---|---|---|---|
| 2007/0290895 | A1* | 12/2007 | Mitchell | G06K 15/00 341/50 |
| 2009/0217135 | A1* | 8/2009 | Busaba | G06F 11/073 714/768 |
| 2010/0321402 | A1* | 12/2010 | Han | G06F 3/1415 345/619 |
| 2011/0199377 | A1* | 8/2011 | Jang | G06T 15/005 345/426 |
| 2011/0275415 | A1* | 11/2011 | Lee | G06F 1/1686 455/566 |
| 2012/0133660 | A1* | 5/2012 | Jang | G06T 15/005 345/541 |
| 2014/0063030 | A1* | 3/2014 | Metcalfe | G06T 1/60 345/531 |
| 2014/0063034 | A1* | 3/2014 | Abarca | G06T 1/60 345/545 |
| 2014/0218378 | A1* | 8/2014 | Roh | G06T 1/60 345/519 |
| 2015/0067433 | A1* | 3/2015 | Wagh | G06F 13/1631 714/748 |
| 2015/0091892 | A1* | 4/2015 | Kwon | G06T 15/005 345/419 |
| 2015/0145858 | A1* | 5/2015 | Park | G06T 15/005 345/419 |
| 2015/0242988 | A1* | 8/2015 | Bolz | G06T 1/20 345/628 |
| 2016/0371182 | A1* | 12/2016 | Herrmann | G06F 12/084 |
| 2017/0162236 | A1* | 6/2017 | Morimoto | G11C 7/1045 |
| 2017/0287384 | A1* | 10/2017 | Lee | G09G 3/20 |
| 2017/0308463 | A1* | 10/2017 | Chang | G11C 16/08 |
| 2018/0040306 | A1* | 2/2018 | Arumugam | G09G 5/393 |
| 2018/0232328 | A1* | 8/2018 | Lassen | G06F 13/28 |

* cited by examiner

PROVIDING DATA TO A DISPLAY IN DATA PROCESSING SYSTEMS

BACKGROUND

The technology described herein relates to data processing systems, and in particular to the processing of data when generating a surface for display on a display.

In data processing systems, an image (frame) that is to be displayed will typically be processed by a number of processing stages before it is finally displayed on a display.

The final image to be displayed is usually stored in a frame buffer in memory, from where it is read by the display controller for the display (e.g. by internal Direct Memory Access (DMA)). The display controller then sends the frame to the display for display (e.g. via a pixel pipeline) (the display may, e.g., be a screen (panel) or printer).

The bandwidth cost of sending pixel data from the display controller to the display can be significant. This is particularly the case where it is desired to display high resolution and/or high frame rate images, e.g. as can be the case for augmented reality (AR) and virtual reality (VR) applications.

The Applicants believe that there remains scope for improvements to data processing systems.

BRIEF DESCRIPTION OF THE DRAWINGS

Various embodiments of the technology described herein will now be described by way of example only and with reference to the accompanying drawings, in which.

Like reference numerals are used for like components throughout the drawings, where appropriate.

DETAILED DESCRIPTION

Figure 1:
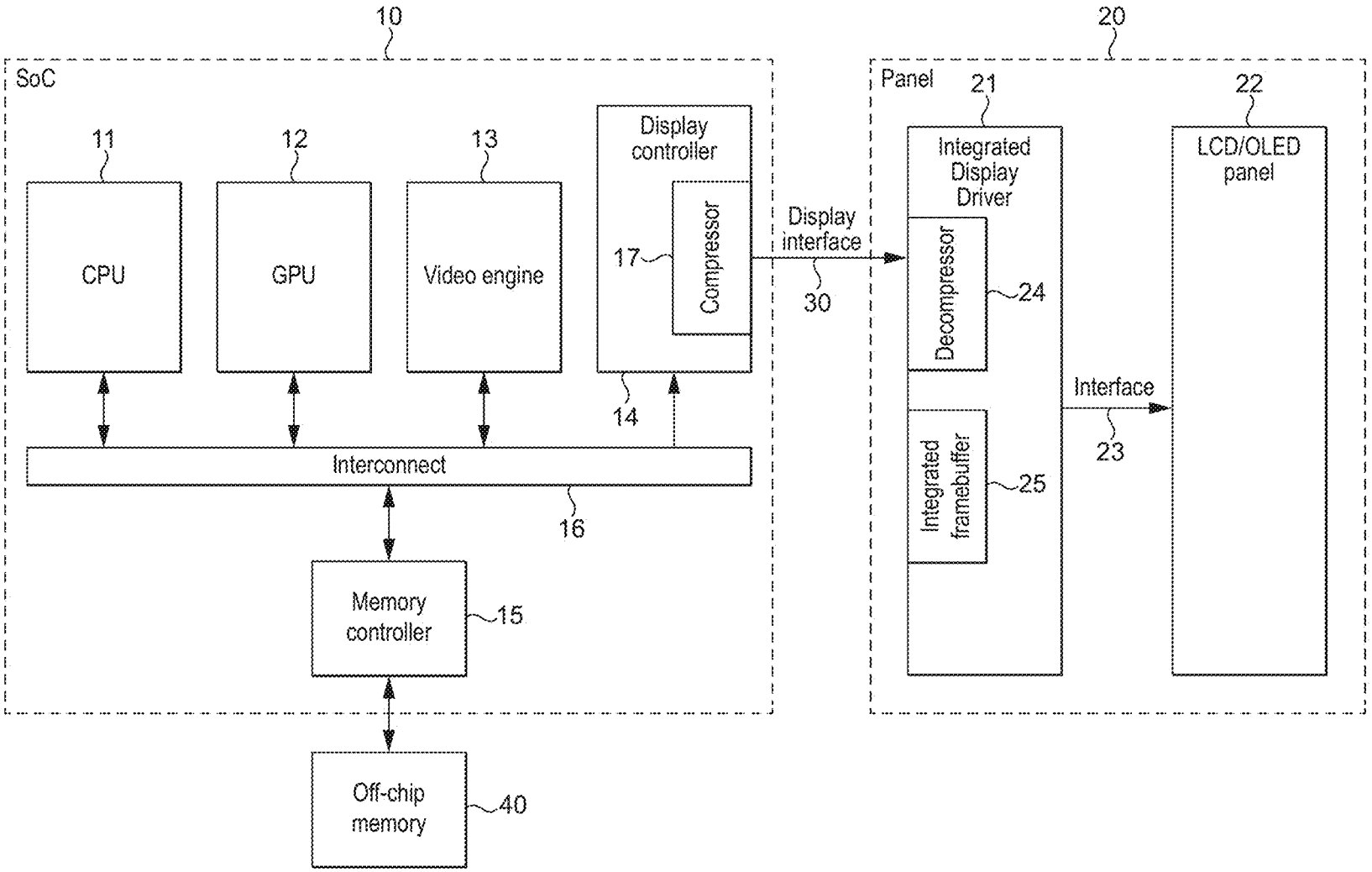
FIG. 1 shows schematically a data processing system in accordance with an embodiment of the technology described herein.

A first embodiment of the technology described herein comprises a method of operating a data processing system that comprises a display and a display controller, the display including a screen and a memory for storing data for an output surface to be displayed on the screen, the method comprising:

the display controller providing to the display data for an output surface to be displayed;

the display storing the output surface data in the memory of the display; and the display reading output surface data from the memory and providing the output surface data to the screen to display an output surface;

the method further comprising:

the display controller indicating to the display a particular memory address of the memory of the display; and the display using the indication to control the reading of output surface data from the memory of the display.

A second embodiment of the technology described herein comprises a data processing system comprising:

a display comprising a screen and a memory for storing data for an output surface to be displayed on the screen; and a display controller operable to provide to the display data for an output surface to be displayed;

wherein the display is operable to read output surface data from the memory and to provide the output surface data to the screen to display an output surface;

wherein the display controller is operable to indicate to the display a particular memory address of the memory of the display; and wherein the display is operable to use the indication to control the reading of output surface data from the memory of the display.

The technology described herein relates to a data processing system in which a display controller is operable to provide data for output surfaces for display to a display. The output surface data provided to the display is stored in a memory of the display, and the display reads the data from the memory and displays output surfaces, e.g. by causing the read data to be displayed on the display's screen.

In the technology described herein, the display controller is operable to indicate to the display a particular memory address of the memory, and the display is operable to use the indication, i.e. to use the particular memory address, to control the reading of output surface data from the memory (and to therefore control the displaying of output surfaces on the screen). For example, the particular memory address may comprise a start address for the reading of data for display from the memory.

As will be described in more detail below, the Applicants have found that configuring a display controller and display in this manner can significantly reduce the bandwidth cost of sending output surface data to the display. In particular, configuring a display controller and display in this manner can allow the display to use data provided to it by the display controller plural times in respect of plural output surfaces to be displayed (i.e. to re-use output surface data). This in turn reduces the amount of data that the display controller must provide to the display, and accordingly reduces the display interface bandwidth and power consumption and the overall memory bandwidth and power requirements of the data processing system.

It will be appreciated, therefore, that the technology described herein provides an improved data processing system.

The technology described herein also extends to the operation solely of a data processing system indicating to a display an initial memory address in the manner of the technology described herein.

Thus, a third embodiment of the technology described herein comprises a method of operating a data processing system that comprises a display controller operable to provide to a display data for output surfaces to be displayed, the method comprising:

the display controller providing to a display data for an output surface to be displayed; and the display controller indicating to the display a particular memory address of a memory of the display for use by the display to control reading of output surface data from the memory of the display.

A fourth embodiment of the technology described herein comprises a data processing system comprising:

a display controller operable to provide to a display data for output surfaces to be displayed; and processing circuitry operable to indicate to the display a particular memory address of a memory of the display for use by the display to control reading of output surface data from the memory of the display.

The technology described herein also extends to the operation solely of a display using a particular memory address indication to control reading of output surface data from a memory of a display in the manner of the technology described herein.

Thus, a fifth embodiment of the technology described herein comprises a method of operating a display, the display including a screen and a memory for storing data for an output surface to be displayed on the screen, the method comprising the display:

receiving data for an output surface to be displayed;

storing the output surface data in the memory of the display; and reading output surface data from the memory and providing the output surface data to the screen to display an output surface;

the method further comprising the display:

receiving an indication of a particular memory address of the memory of the display; and using the indication to control reading of output surface data from the memory of the display.

A sixth embodiment of the technology described herein comprises a display comprising:

a screen;

a memory for storing data for an output surface to be displayed on the screen; and processing circuitry configured to receive data for an output surface to be displayed and store the output surface data in the memory of the display;

wherein the display is operable to read output surface data from the memory and to provide the output surface data to the screen to display an output surface;

wherein the display is operable to receive an indication of a particular memory address of the memory of the display; and wherein the display is operable to use the indication to control the reading of output surface data from the memory of the display.

In the technology described herein, the output surface to be displayed may comprise any suitable such surface (e.g. frame) for display. The output surface is in an embodiment one such output surface (frame) in a sequence of output surfaces (frames) for display.

The or each output surface is in an embodiment an image, e.g. frame, for display. The or each output surface (frame) in an embodiment comprises an array of plural data positions, with each data position taking a particular data (e.g. colour) value. Thus, the or each output surface (frame) in an embodiment comprises plural lines of data positions and plural columns of data positions.

The data values for the data positions of the data array can be any suitable and desired data values. In an embodiment, the data values represent colour values such as RGB or YUV colour values.

The display controller of the technology described herein may comprise any suitable display controller operable to provide to the display data for output surfaces to be displayed, in an embodiment via one or more appropriate display interfaces (e.g. one or more MIPI, DSI and/or HDMI display interfaces).

The display controller is in an embodiment operable to read data for one or more input surfaces to be displayed, in an embodiment from memory in which the surface data is stored, and to provide data for an output surface formed from that input surface or those input surfaces to the display for display.

Accordingly the display controller in an embodiment comprises an input stage operable to read one or more input surfaces. In an embodiment, the input stage comprises a read controller, such as for example a Direct Memory Access (DMA) read controller.

The display controller is operable to provide data for output surfaces to the display. Thus, the display controller in an embodiment comprises an output stage operable to provide output surface data to the display. This output stage may be any suitable such output stage operable to provide output surface data to the display.

The display controller may read data in respect of a single surface that it then provides all or part of to the display, or, the display controller may read in, and in an embodiment combine, data in respect of plural surfaces that it then provides all or part of to the display.

The input surface(s) to the display controller may comprise, for example, one or more surfaces generated by a frame generator or generators, and/or a composited output surface composed by a composition stage or stages, etc.

Thus, the data processing system in an embodiment comprises one or more processing stages, e.g. frame generators, that is or are operable to generate the output surface for display or to generate one or more surfaces that are used to form the output surface.

The frame generator processing stage(s) may comprise, for example, a graphics processing unit (GPU), a video processing unit (VPU), video codec or video engine, a digital camera image signal processor (ISP), an image processor, and/or a central processing unit (CPU), etc. There may be more than one frame generator, if desired.

The or each frame generator should generate its surface in an appropriate manner, e.g. by rendering the surface in the case of a graphics processor, by appropriately decoding input encoded video data in the case of a VPU, video codec or video engine, from a captured image in the case of a digital camera image signal processor (ISP), etc.

The data processing system may also include a processing stage or stages that is or are operable to process a previously generated surface or surfaces, e.g. in order to produce an, e.g., modified version of that surface or surfaces.

For example, the data processing system may comprise a composition stage or engine operable to compose (two or more) surfaces to generate a composited output surface. In this case, the surfaces that are composed by the composition stage in an embodiment comprise (two or more of) the surfaces generated by the one or more frame generators. Accordingly, the composition stage is in an embodiment operable to read (two or more) surfaces from memory, and to compose the surfaces to generate a composited surface (e.g. by blending or otherwise combining the surfaces). The composition stage may store the composited output surface in memory or alternatively, e.g. where the composition stage is part of the display controller, the composition stage may pass all of part of the composited output surface (directly) to the display, e.g. via the display interface(s). In an embodiment, the composited surface is to be used as the output surface for display.

The data processing system may also or instead (and in an embodiment also) comprise one or more processing stages that are operable to perform other types of processing and/or modifications, such as image enhancement, rotation, scaling, etc., to generate the output surface.

One or more or each of the surface generating processing stages may be operable to store their respective output surfaces in memory (and correspondingly to read surfaces that they are to process from memory (where appropriate)). This memory may comprise any suitable memory and may be configured in any suitable and desired manner. For example, it may be a memory that is on chip with and/or local to the processing stage in question or it may be an external memory. In an embodiment it is an external memory, such as a main memory of the data processing system. It may be dedicated memory for this purpose or it may be part of a memory that is used for other data as well. In an embodiment the one or more surfaces are stored in (and read from) one or more frame buffers. For example, respective processing stage frame buffers may be provided in the main memory of the data processing system.

The display controller may provide all or part of an output surface to the display. Thus, the display controller may provide data values for each and every data position of an output surface (data array) to the display, or may provide data values for only some (but not all) data positions of an output surface (data array) to the display.

In an embodiment, the display controller is operable (or the data processing system is operable to cause the display controller), for each output surface in the sequence of output surfaces for display, to selectively provide all or part of the output surface to the display. Thus, the display controller may provide all of an output surface (data values for the entire data array) to the display for one or more output surfaces in the sequence of output surfaces for display and may provide part (some but not all) of an output surface (data values for some (but not all) data positions of the data array) to the display for one or more other output surfaces in the sequence of output surfaces for display.

The display controller may provide part of an output surface to the display where, for example, the display already has access to (other) output surface data that may be used for the output surface in question (e.g. since that data is already stored in the memory of the display).

This may be the case, for example, where the data values of one or more data positions of an output surface have not (have other than) changed relative to the corresponding data positions of a previous version of the output surface (e.g. relative to the previous output surface in the sequence of output surfaces). In these embodiments, the display controller may provide to the display (only) data values for data positions whose data values have changed relative to a previous version of the output surface (and may not provide to the display data values for data positions whose data values have not changed relative to a previous version of the output surface).

This may also be the case in other situations, such as where an output surface has changed relative to a previous version of the output surface by a translation (only), which will be described in more detail below.

The use of this "partial frame update" mode (where appropriate) can reduce the amount of data that the display controller provides to the display, and can accordingly reduce the display interface bandwidth and power consumption and the overall memory bandwidth and power requirements of the data processing system.

The display of the technology described herein may comprise any suitable display, such as for example, a screen (such as a panel) or a printer. The display may comprise a single screen (e.g. panel) or may comprise plural screens (panels).

In one embodiment, the display is a head-mounted display, e.g. a virtual reality (VR) or augmented reality (AR) head mounted display (HMD) system.

The display is in an embodiment configured to receive data for output surfaces to be displayed from the display controller, in an embodiment via the display interface(s).

The memory of the display may comprise any suitable memory. The memory is in an embodiment an integrated memory of the display, e.g. frame buffer, for storing some or all of the data provided to the display by the display controller and/or output surface data produced by the display.

The memory should (and in an embodiment does) have a particular size, i.e. a total number of memory locations, e.g. for storing output surface data. Each of the memory locations in an embodiment has its own memory address. Each of the memory locations may be configured to store data in respect of a single data position (pixel) of the output surface to be displayed, but other arrangements would be possible.

The memory should be (and in an embodiment is) able to store at least (and in an embodiment only) data for an output surface (a frame), e.g. in respect of the maximum output surface (data array) size (resolution) that the display is configured to display (support). Thus, the memory in an embodiment has a size (i.e. a total number of memory addresses for storing output surface data) that is sufficient to store at least (and in an embodiment only (i.e. that is not (is other than) larger than is necessary to store)) one (full) output surface (frame) of data for the maximum output surface (data array) size (resolution) that the display is configured to display.

In the technology described herein, output surface data provided to the display by the display controller is stored in the memory of the display. Thus, in an embodiment, the display is configured to store output surface data provided to it by the display controller in the memory.

The output surface data is in an embodiment stored in the memory such that the data (e.g. colour) value of one or more, in an embodiment each, data position (pixel) of the or each output surface (data array) is stored at a single memory location of the memory, i.e. such that the data (e.g. colour) value of one or more, in an embodiment each, data position (pixel) is stored in the memory using a single memory address of the memory.

The output surface data is in an embodiment stored in the memory in raster (line) order, i.e. such that the data values of at least some lines, and in an embodiment each line, of each output surface (data array) are stored in the memory in memory locations with contiguous memory addresses, and such that the data values of adjacent lines of the output surface are stored in sets of memory locations with adjacent memory addresses. Other arrangements would, however, be possible.

Where, as described above, the display controller provides all of an output surface to the display (i.e. for a particular output surface in the sequence of output surfaces (frames) for display), then a data value for each and every data position of the output surface (data array)) is in an embodiment stored in the memory. This in an embodiment comprises writing over (in an embodiment all of) any output surface data that is already stored in the memory (e.g. in respect of a previous output surface for display).

Where, on the other hand, the display controller provides part of an output surface to the display (i.e. for a particular output surface in the sequence of output surfaces (frames) for display), then the data in respect of part of the output surface (i.e. data values for only some (but not all) data positions of the output surface (data array)) is in an embodiment stored in the memory. In this case, where output surface data is already stored in the memory, then in an embodiment (only) part (some but not all) of the output surface data that is already stored in the memory is written over.

In the technology described herein, the display is configured to read output surface data from the memory and to display output surfaces. The display should (and in an embodiment does) comprise suitable processing circuitry configured to read output surface data from the memory, and in an embodiment to cause the output surface data to be displayed.

The display is in an embodiment configured to read data in respect of each output surface (frame) in the sequence of output surfaces (frames) for display in turn (one by one), and to display each output surface (frame) in the sequence of output surfaces (frames) for display in turn (one by one). Thus, the display is in an embodiment configured to repeatedly read output surface data from the memory (and to repeatedly display that output surface data).

For each output surface to be displayed, the display in an embodiment reads all of the output surface data in the memory (and displays all of the output surface data). That is, for each output surface to be displayed, the display in an embodiment reads each and every memory location of the memory (and then causes that data to be displayed). Thus, the display is in an embodiment configured to repeatedly read all of the output surface data in the memory (to repeatedly read each and every memory location of the memory), and to cause that data to be displayed.

In an embodiment, for each output surface to be displayed, the display reads the data from the memory in memory address order. In an embodiment, the memory is configured to operate as a circular buffer.

Thus, for example, for each output surface to be displayed, the display may read data from the memory beginning with the first memory address of the memory, and continuing in memory address order to the last memory address of the memory. The display may then continue reading data from the memory from the first memory address of the memory (e.g. for the next output surface to be displayed), and so on. Alternatively, for each output surface to be displayed, the display may read data from the memory beginning with the last memory address of the memory, and continuing in (reverse) memory address order to the first memory address of the memory. The display may then continue reading the memory from the last memory address of the memory (e.g. for the next output surface to be displayed), and so on. Other arrangements would, however, be possible.

It will accordingly be appreciated that, where all of a particular output surface is provided to the display by the display controller, then the display will in an embodiment read and display (only) the data provided to the display in respect of that particular output surface. Where, on the other hand, (only) part of a particular output surface is provided to the display by the display controller, then the display will in an embodiment read and display the data provided to the display in respect of that particular output surface together with output surface data that is already present in (that was already stored in) the memory (e.g. data in respect of a previous output surface).

In the technology described herein, the display controller is operable to indicate to the display a particular memory address of the memory, and the display is configured to use the indication, i.e. to the use particular memory address, to control the reading of output surface data from the memory.

The display controller may be operable to indicate the particular memory address to the display in any suitable manner. The display controller is in an embodiment configured to indicate the particular memory address to the display via the display interface(s).

In an embodiment, the display controller is operable to provide the particular memory address to the display. However, it would also or instead be possible for the display controller to provide to the display some other information, i.e. from which the display is in an embodiment operable to determine the particular memory address. For example, the display controller may provide to the display a memory address offset, or similar, e.g. that is in an embodiment used by the display to determine the particular memory address (e.g. by adding (or subtracting) the offset from a previous version of the particular memory address, or otherwise). Other arrangements would be possible.

The display controller is in an embodiment configured to indicate the particular memory address to the display in respect of a particular output surface for display. In other words, the or each particular memory address that is indicated to the display is in an embodiment related to (and is in an embodiment to be used in respect of) one or more particular output surfaces in the sequence of output surfaces for display.

In an embodiment, the display controller is operable (or the data processing system is operable to cause the display controller), for each output surface in the sequence of output surfaces for display, to selectively indicate to the display a particular memory address of the memory. Thus, the display controller may indicate to the display a particular memory address for one or more output surfaces in the sequence of output surfaces for display (and may not (may other than) indicate to the display a particular memory address for one or more other output surfaces in the sequence of output surfaces for display).

In these embodiments, the or each memory address that is indicated to the display may be indicated to the display together with (at the same time as) providing the data to the display for the related output surface.

In these embodiments, the or each memory address that is indicated to the display is in an embodiment used by the display to control the reading of data from the memory for the related output surface.

Thus, in an embodiment, the method of the technology described herein comprises:

the display controller providing to the display data for an output surface to be displayed;

the display storing the data for the output surface in the memory of the display;

the display controller indicating to the display a particular memory address of the memory of the display for the output surface; and the display using the indication to control the reading of data from the memory for the output surface and providing the output surface data to the screen to display the output surface.

In these embodiments, where a particular memory address is not (is other than) indicated to the display in respect of an output surface, then the data for that output surface may be read from the memory in a "default" manner (e.g. by reading the data from the memory beginning with the first memory address of the memory, and continuing in memory address order to the last memory address of the memory, as described above).

The particular memory address may be any suitable memory address of the memory's memory addresses, and the particular memory address (indication) may be used to control the reading of data from the memory in any suitable manner.

The particular memory address is in an embodiment a memory address other than the first (or the last) memory address of the memory, i.e. is in an embodiment an intermediate memory address of the memory.

The particular memory address (indication) is in an embodiment used by the display to determine which memory address of the memory it should begin reading from, i.e. in order to display a particular (i.e. the related) output surface. In an embodiment, the display is configured to begin reading the memory from the particular memory address, i.e. in order to display the particular (related) output surface.

Thus, in an embodiment the particular memory address is an initial (start) memory address of the memory, i.e. from which the display should begin its reading in respect of a particular (related) output surface. Correspondingly, the display is in an embodiment configured to use the indication to control the reading of data from the memory by reading data from the memory beginning with the particular memory address of the memory for the particular (related) output surface (rather than with the first (or last) memory address as would otherwise be the case).

As described above, the memory is in an embodiment configured to operate as a circular buffer. Thus, for a particular output surface to be displayed, the display may read data from the memory beginning with the (related) particular memory address, continuing in memory address order to the last memory address of the memory, then continuing from the first memory address of the memory in memory address order to the memory address of the memory that immediately precedes the particular memory address.

(Alternatively, for a particular output surface to be displayed, the display may read data from the memory beginning with the (related) particular memory address, continuing in (reverse) memory address order to the first memory address of the memory, then continuing from the last memory address of the memory in (reverse) memory address order to the memory address of the memory that immediately follows the particular memory address.)

The display may then continue reading data from the memory from the first (or last) memory address of the memory, from the particular memory address, or from any other memory address of the memory (e.g. depending on whether the display controller indicates to the display a different particular memory address for the next output surface to be displayed), and so on.

Thus, in a in an embodiment, the method comprises:

the display controller providing to the display data for an output surface to be displayed;

the display storing the data for the output surface in the memory of the display;

the display controller indicating to the display a particular memory address of the memory for the output surface; and the display reading data for the output surface from the memory of the display beginning with the particular memory address of the memory and providing the output surface data to the screen to display the output surface.

In this regard, the Applicants have recognised that configuring a display controller and display in this manner allows the display to use data provided to it by the display controller plural times in respect of plural output surfaces to be displayed (i.e. to re-use output surface data).

In particular, the Applicants have recognised that where an output surface is related to a previous version of the output surface (i.e. to the previous output surface in the sequence of output surfaces) by a (horizontal and/or vertical) translation (of the data array) (only), then although the data value of each individual data position may have changed relative to the previous version of the data value for that data position, the memory will nevertheless store some data that can be used for the new output surface (i.e. where this data is in effect translated within the memory) (so long as the (horizontal and/or vertical) translation is less than the (horizontal and/or vertical) size of the output surface (frame)).

The Applicants have furthermore recognised that, by controlling the display to begin its reading of the memory from a memory location other than the memory location having the first (or last) memory address of the memory, this data can be appropriately re-used when displaying the (current) output surface. This in turn reduces the amount of data that the display controller must provide to the display, and accordingly reduces the display interface bandwidth and power consumption and the overall memory bandwidth and power requirements of the data processing system.

In addition, there are other situations where controlling the display to begin its reading of the memory from a memory location other than the memory location having the first (or last) memory address of the memory can allow data to be re-used, e.g. such as where one or more sub-regions of an output surface are related to a previous version of the one or more sub-regions by a (horizontal and/or vertical) translation (only). The techniques of the technology described herein may also be used where an output surface is not only related to a previous version of the output surface by a translation, but is additionally related by some other (image) modification(s), e.g., where the other modification(s) is or are sufficiently small, so that they can effectively be ignored (e.g. without significantly affecting the quality of the displayed image).

In an embodiment, the data processing system is configured to determine the particular memory address, i.e. before it is indicated to (provided to) the display. The particular memory address may be determined by any suitable part of the data processing system and in any suitable manner.

In one embodiment, the particular memory address is determined using translation information, i.e. information indicating a degree to which and/or a direction in which the current output surface has been translated with respect to the previous output surface.

Such information can be obtained, for example, from head tracking information, e.g. from a head mounted display (e.g. virtual reality (VR) or augmented reality (AR) headset), or from a user input device (e.g. controller), e.g. where the user input device is used to control the position and/or orientation of a "camera" (viewpoint) for generating output surfaces. This represents a particularly convenient arrangement, since for example, such information may be readily available to the data processing system.

Such translation information could also or instead be obtained, for example, from the frame generator(s) (e.g. GPU, VPU, etc.) that generates the successive output frames, and/or from a host processor (e.g. CPU) that controls the operation of the frame generator(s) to generate the successive output frames (e.g. as required by an application executing on the host processor).

It would also or instead be possible to determine the translation information (and thereby the particular memory address) by comparing successive output frames (e.g. by the current output surface with the previous output surface), i.e. so as to determine the degree to which and/or the direction in which the current output surface has been translated with respect to the previous output surface. This may be done, for example, by a video processor, that is operable to perform frame-to-frame comparisons, e.g. as part of its encoding operation (e.g. that includes motion-estimation) (i.e. by a motion-estimation engine of a video-encoder).

Other arrangements would be possible.

Thus, in an embodiment, the method comprises:

obtaining translation information indicating a degree to which and/or a direction in which the output surface has been translated with respect to a previous version of the output surface;

determining a particular memory address using the translation information; and indicating the particular memory address to the display (and the data processing system is in an embodiment configured in a corresponding manner).

The particular memory address is in an embodiment determined (selected) such that at least some data that is already stored in the memory (e.g. in respect of the previous output surface for display) will be re-used by the display when the display reads the data from the memory, i.e. to display the (current) output surface.

The particular memory address is in an embodiment determined (selected) such that when the display reads the data from the memory beginning with the particular memory address (e.g. as described above), the data that is to be re-used will be displayed on the display in the appropriate position.

In an embodiment, the particular memory address comprises the first memory address of the memory at which output surface data (of the previous version of the output surface) that is to be re-used is stored (e.g. for a positive translation), or the first memory address of the memory at which output surface data (of previous version of the output surface) that is not to be (that is other than to be) re-used is stored (e.g. for a negative translation). Other arrangements would be possible.

In these embodiments, where an output surface is related to a previous version of the output surface (i.e. to the previous output surface in the sequence of output surfaces) by a (horizontal and/or vertical) translation (of the data array) (only), and where the display begins reading output data from the particular memory address, then at least some output surface data will need to be (and is in an embodiment) provided to the display, e.g. for those regions (sub-regions) of the output surface that were not (were other than) present in the previous version of the output surface. This is in an embodiment done using "partial frame update", e.g. as described above.

However, in this case, the data value of each individual data position may have changed relative to the previous version of the data value for that data position, and so it will not be possible to perform a "standard" partial frame update as described above (i.e. whereby the display controller provides to the display data values for data positions whose data values have changed relative to the previous version of the output surface).

In this regard, the Applicants have recognised that, in the case of a (horizontal and/or vertical) translation, some (translated) data stored in the memory can be used for the new output surface, but other parts of the output surface data stored in the memory will not (will other than) be needed for the new output surface (i.e. those parts of the output surface data that are in effect caused to be "off-screen" by the translation). Furthermore, these (off-screen) parts of the stored output surface data (that are not needed for the new output surface) will typically comprise an equal amount of data as (will have the same size as) the amount of new output surface data that is required for the new output surface.

In other words, in the case of a (horizontal and/or vertical) translation, parts of the output surface data that are caused to be "off-screen" by the translation will have the same size as the new parts of the output surface data that are caused to be "on-screen" by the translation.

Moreover, the Applicants have recognised that where the new "on-screen" output surface data is stored in the memory in place of (is written over) the "off-screen" parts of the output surface data, then when the data is read from the memory beginning with the particular memory address and continuing in memory address order (i.e. in the manner of a circular buffer, as described above), the new output surface will be displayed appropriately on the display.

Thus, for example, where the data is stored in the memory in raster (line) order (as described above), a vertical translation will in effect cause one or more lines of the output surface (data array) to be in effect "off-screen", while one or more new lines will be caused to be "on-screen". By storing the new "on-screen" lines in the memory (in raster (line) order) at memory locations at which the "off-screen" lines were previously stored, then when data is read from the memory beginning with the particular memory address, continuing in memory address order to the last memory address of the memory, and then continuing from the first memory address of the memory in memory address order to the memory address of the memory that immediately precedes the particular memory address (i.e. in the manner of a circular buffer, as described above), the new output surface will be displayed appropriately on the display.

Similarly, a horizontal translation will in effect cause one or more data positions of each line of the output surface (data array) to be in effect "off-screen", while new data positions at the other end of each line will be caused to be "on-screen". By storing the new "on-screen" data positions in the memory (in raster (line) order) at memory locations at which the "off-screen" data positions were previously stored, then when the data is read from the memory in memory address order (i.e. in the manner of a circular buffer, as described above), the new output surface will be displayed appropriately on the display.

Thus, in an embodiment, the method comprises:

the display controller providing to the display data for one or more sub-regions of the output surface that were other than present in a previous version of the output surface; and the display storing the data in the memory by writing over data for one or more sub-regions of the previous version of the output surface that are not (are other than) present in the (new) output surface.

The display controller in an embodiment does not provide (other than provides) to the display data for one or more sub-regions of the output surface that were present in a previous (translated) version of the output surface.

Although the above embodiments have been described in terms of the display being configured to read the data from the memory in memory address order beginning with a single memory address of the memory (and continuing in memory address order), it would also be possible for the display to be configured to read the data from the memory in a tiled manner. That is, for each output surface to be displayed, the display may read the data of plural different sub-regions (tiles) of the output surface, e.g. in parallel.

Thus, for each output surface to be displayed, the display may read data from the memory beginning with plural different memory addresses of the memory (and continuing in memory address order).

In this case, the display controller may indicate to the display plural particular memory addresses of the memory of the display, and the display may use the indications to control the reading of output surface data from the memory of the display.

These embodiments may be particularly useful where, for example, the translation is constrained to have a magnitude that corresponds to the size of an integer number of sub-regions (tiles). In this case, only data for sub-regions (tiles) that were not (were other than) present in the previous version of the output surface need to be (and is in an embodiment) provided to the display.

Thus, the method may comprise:

the display controller providing to the display data for one or more regions (e.g. tiles) of an output surface to be displayed;

the display storing the output surface region data in the memory of the display; and the display reading output surface region data from the memory and providing the output surface data to the screen to display one or more regions of an output surface;

the method further comprising:

the display controller indicating to the display, for each of one or more regions of the output surface, a particular memory address of the memory of the display; and the display using the indication or indications to control the reading of output surface region data from the memory of the display.

Although the technology described herein is described above with particular reference to the processing of a given output surface for display, as will be appreciated by those skilled in the art, the technology described herein can be, and is in an embodiment, used for providing plural output surfaces for display, and in an embodiment for providing a sequence of output surfaces (e.g. frames) to be displayed to a display.

The various stages of the data processing system may be implemented as desired, e.g. in the form of one or more fixed-function units (hardware) (i.e. that is dedicated to one or more functions that cannot be changed), or as one or more programmable processing stages, e.g. by means of programmable circuitry that can be programmed to perform the desired operation. There may be both fixed function and programmable stages.

One or more of the various processing stages of the technology described herein may be provided as separate circuit elements to one another. Additionally or alternatively, some or all of the stages may be at least partially formed of shared circuitry.

One or more of the various stages of the technology described herein may be operable to always carry out its function on any and all received surfaces. Additionally or alternatively, one of more of the stages may be operable to selectively carry out its function on the received surfaces, i.e. when desired and/or appropriate.

The data processing system may and in an embodiment does also comprise one or more of, and in an embodiment all of: a central processing unit, a graphics processing unit, a video processor (codec), a system bus, a memory controller, and additional elements as known to those skilled in the art.

The data processing system may be, and in an embodiment is, configured to communicate with one or more of (and the technology described herein also extends to an arrangement comprising one or more of): an external memory (e.g. via the memory controller), one or more local displays, and/or one or more external displays.

In an embodiment, the data processing system further comprises a or the display. The display that the display controller is used with may be any suitable and desired display, such as for example, a screen or a printer.

The technology described herein can be implemented in any suitable system, such as a suitably configured micro-processor based system. In an embodiment, the technology described herein is implemented in a computer and/or micro-processor based system.

The various functions of the technology described herein can be carried out in any desired and suitable manner. For example, the functions of the technology described herein can be implemented in hardware or software, as desired. Thus, for example, unless otherwise indicated, the various functional elements and "means" of the technology described herein may comprise a suitable processor or processors, controller or controllers, functional units, circuitry, processing logic, microprocessor arrangements, etc., that are operable to perform the various functions, etc., such as appropriately dedicated hardware elements and/or programmable hardware elements that can be programmed to operate in the desired manner.

It should also be noted here that, as will be appreciated by those skilled in the art, the various functions, etc., of the technology described herein may be duplicated and/or carried out in parallel on a given processor. Equally, the various processing stages may share processing circuitry, etc., if desired.

Furthermore, any one or more or all of the processing stages of the technology described herein may be embodied as processing stage circuitry, e.g., in the form of one or more fixed-function units (hardware) (processing circuitry), and/or in the form of programmable processing circuitry that can be programmed to perform the desired operation. Equally, any one or more of the processing stages and processing stage circuitry of the technology described herein may comprise a separate circuit element to any one or more of the other processing stages or processing stage circuitry, and/or any one or more or all of the processing stages and processing stage circuitry may be at least partially formed of shared processing circuitry.

Subject to any hardware necessary to carry out the specific functions discussed above, the graphics processing pipeline can otherwise include any one or more or all of the usual functional units, etc., that graphics processing pipelines include.

The display processor in an embodiment also comprises, and/or is in communication with, one or more memories and/or memory devices that store the data described herein, and/or that store software for performing the processes described herein. The display processor may also be in communication with the host microprocessor, and/or with a display for displaying images based on the data generated by the display processor.

It will also be appreciated by those skilled in the art that all of the described embodiments of the technology described herein can, and in an embodiment do, include, as appropriate, any one or more or all of the features described herein.

The methods in accordance with the technology described herein may be implemented at least partially using software e.g. computer programs. It will thus be seen that when viewed from further embodiments the technology described herein provides computer software specifically adapted to carry out the methods herein described when installed on a data processor, a computer program element comprising computer software code portions for performing the methods herein described when the program element is run on a data processor, and a computer program comprising code adapted to perform all the steps of a method or of the methods herein described when the program is run on a data processing system. The data processor may be a microprocessor system, a programmable FPGA (field programmable gate array), etc.

The technology described herein also extends to a computer software carrier comprising such software which when used to operate a graphics processor, renderer or microprocessor system comprising a data processor causes in conjunction with said data processor said processor, renderer or system to carry out the steps of the methods of the technology described herein. Such a computer software carrier could be a physical storage medium such as a ROM chip, CD ROM, RAM, flash memory, or disk, or could be a signal such as an electronic signal over wires, an optical signal or a radio signal such as to a satellite or the like.

It will further be appreciated that not all steps of the methods of the technology described herein need be carried out by computer software and thus from a further broad embodiment the technology described herein provides computer software and such software installed on a computer software carrier for carrying out at least one of the steps of the methods set out herein.

The technology described herein may accordingly suitably be embodied as a computer program product for use with a computer system. Such an implementation may comprise a series of computer readable instructions either fixed on a tangible, non-transitory medium, such as a computer readable medium, for example, diskette, CD ROM, ROM, RAM, flash memory, or hard disk. It could also comprise a series of computer readable instructions transmittable to a computer system, via a modem or other interface device, over either a tangible medium, including but not limited to optical or analogue communications lines, or intangibly using wireless techniques, including but not limited to microwave, infrared or other transmission techniques. The series of computer readable instructions embodies all or part of the functionality previously described herein.

Those skilled in the art will appreciate that such computer readable instructions can be written in a number of programming languages for use with many computer architectures or operating systems. Further, such instructions may be stored using any memory technology, present or future, including but not limited to, semiconductor, magnetic, or optical, or transmitted using any communications technology, present or future, including but not limited to optical, infrared, or microwave. It is contemplated that such a computer program product may be distributed as a removable medium with accompanying printed or electronic documentation, for example, shrink wrapped software, preloaded with a computer system, for example, on a system ROM or fixed disk, or distributed from a server or electronic bulletin board over a network, for example, the Internet or World Wide Web.

Embodiments of the technology described herein will now be described with reference to the Figures.

FIG. 1 shows schematically a data processing system in accordance with an embodiment. The data processing system comprises a system on chip (SoC) 10 that it configured to provide image data to a display 20 via a display interface 30.

The system on chip 10 comprises a central processing unit (CPU) 11, a graphics processing unit (GPU) 12, a video processing unit (VPU), video engine or codec 13, a display controller 14, and a memory controller 15. The system on chip 10 could also comprise an image processor such as a composition engine and/or a camera image signal processor (ISP) (not shown), if desired.

As shown in FIG. 1, these communicate via an interconnect 16 and have access to off-chip main memory 40. The display controller 14 communicates with the display 20 via the display interface 30 so as to cause output frames (surfaces) to be displayed by the display 20.

The display 20 comprises an integrated display driver 21 and a display panel 22, e.g. that may be a liquid crystal display (LCD) panel, an organic light emitting diode (OLED) panel or otherwise. The integrated display driver 21 is operable to cause frames to be displayed on the display panel 22 via an internal interface 23.

In operation, a frame generator (e.g. the CPU 11, GPU 12, or video engine 13) generates a frame (surface) and stores it in main memory 40, e.g. in a frame buffer. One or more of these stored frames may be read from the memory 40 by the display controller 14, which optionally combines (e.g. composes) the read frames, and sends a frame for display to the display 20.

Figure 2:
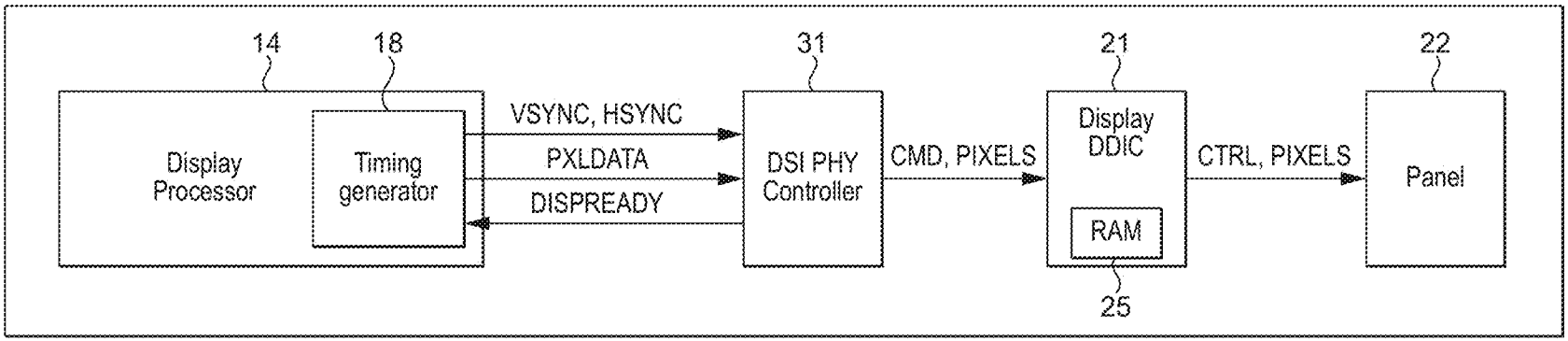
FIG. 2 shows schematically a data processing system in accordance with an embodiment of the technology described herein.

FIG. 2 illustrates this process in more detail. As shown in FIG. 2, the display controller 14 comprises a display timing unit 18. The display timing unit 18 sends pixel data to the display 20 with appropriate horizontal and vertical blanking periods via a DSI display interface 31. This data is received by the display driver 21 of the display, stored in the RAM memory 25, and provided to the panel 22 for display.

Although FIGS. 1 and 2 illustrate an arrangement comprising a single display panel 22, it would be possible for the display 20 to comprise plural display panels. This may be the case, for example, for displays intended for virtual reality or augmented reality use. In this case, the display may comprise a left panel configured to be viewed by the left eye and a right panel configured to be viewed by the right eye.

Although FIGS. 1 and 2 illustrate an arrangement whereby the display controller 14 provides output frame data to the display 20 via a single display interface 30, it would also be possible for the display controller 14 to provide data to the display 20 via plural display interfaces. This may be the case where the panel 22 has a particularly high resolution, and/or where the panel 22 is configured to display a pair of stereoscopic output surfaces. For example, the display 20 may receive data in respect the left image from the display controller 14 via a first display interface and may receive data in respect the right image from the display controller 14 via a second different display interface.

It would also or instead be possible for plural interfaces to be grouped together and to be effectively treated and used as a single interface.

Sending the data from the display controller 14 to the display 20 requires a significant amount of bandwidth. This is the case, for example, when 4K frames are sent to the display at 30 fps or 60 fps, and even more so for virtual reality (VR) or augmented reality (AR) applications, where it may be necessary to transfer a pair of 4K frames (i.e. one for each eye) at 90 fps or even 120 fps.

As shown in FIG. 1, the system on chip 10 of the present embodiment may be configured to compress the frame for display, e.g. using a compressor 17, before it is sent to the display 20 for display. Correspondingly, the display 20 is configured to decompress compressed frames received from the display controller 14, e.g. using a decompressor 24 that is part of the integrated display driver 21. The integrated display driver 21 also comprises an integrated frame buffer 25 for storing the compressed data received from the display controller 14 and/or the decompressed data produced by the decompressor 24.

Figure 3:
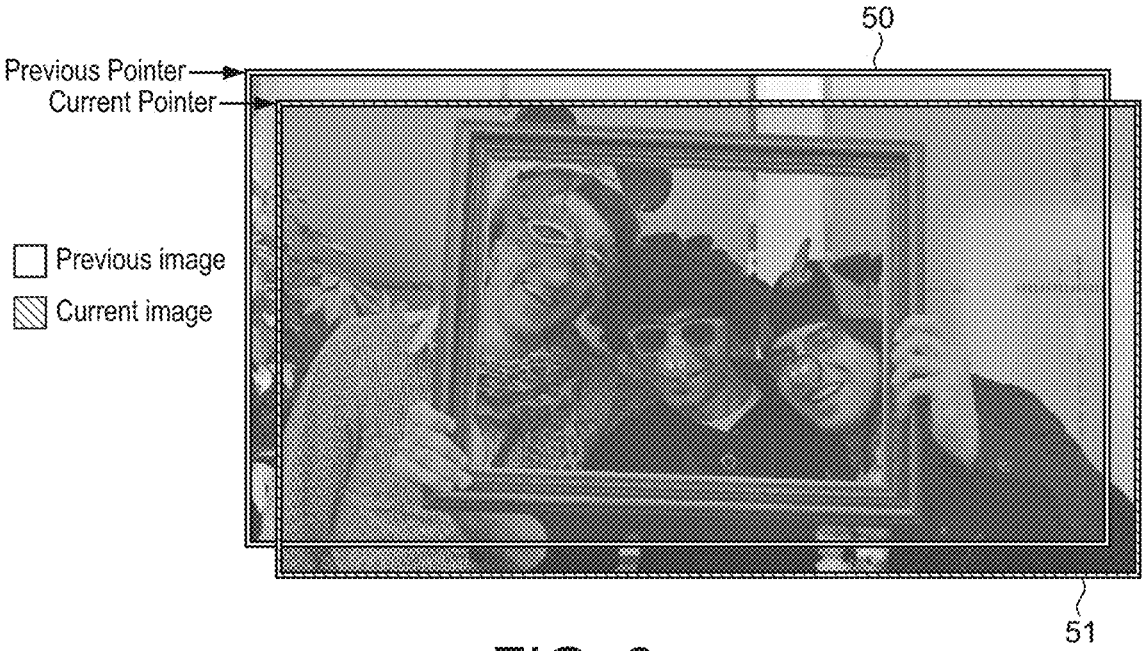
FIG. 3 shows an example of a current image and a previous image that may be provided to a display in accordance with an embodiment of the technology described herein.

FIG. 3 illustrates a technique that can be used to further reduce the bandwidth required for sending image data from the display controller 14 to the display 20 in accordance with the technology described herein.

Figure 4A:
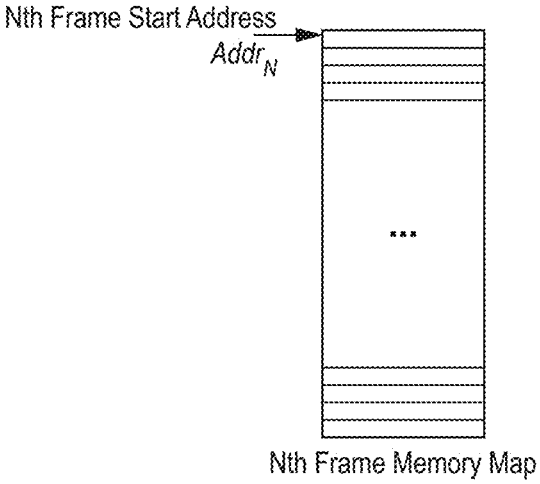
FIG. 4A shows schematically a memory map that may be used to store the previous image of FIG. 3.

FIG. 3 shows a new frame 51 and a previous frame 50. The previous frame 50 is stored in the frame buffer 25 of the display 20. As illustrated by FIG. 4A, the previous frame is stored in the frame buffer 25 in raster line order. Thus, each line of data is stored at a contiguous set of memory addresses of the memory, where adjacent lines of the image are stored at adjacent sets of memory addresses.

In the example illustrated in FIG. 3, the new frame 51 is a horizontally and vertically translated version of the previous frame 50. As can be seen from FIG. 3, in this case, a significant part of the image data for the new frame 51 is the same as image data for the previous frame 50. As such, a significant part of the image data for the new frame 51 will already be stored in the frame buffer 25.

In accordance with the present embodiment, this data is re-used. This is done by the display controller 14 indicating to the display 20 an initial memory address of the frame buffer 25 that the display 20 should begin its reading operation from. As shown in FIG. 3, this may be in the form of a memory address offset, e.g. which may be added to the previous initial memory address to determine the particular memory address that the display should begin reading from. It would also be possible for the display to provide the absolute value of the initial memory address to the display.

Thus, in the present embodiment, the starting address (start address pointer) for reading each frame from the display frame buffer 25 can be updated, e.g. using command mode.

The display is configured to then begin its reading operation from the indicated memory address.

In these arrangements, the display's frame buffer memory addressing is configured to operate as a circular buffer. Thus, the display will begin its reading from the indicated memory address, continue reading in memory address order until the last memory address of the memory, and then continue with the first memory address of the memory (until the memory address immediately preceding the indicated memory address).

The display can then begin reading the next frame from any appropriate memory address (e.g. the first memory address, the indicated memory address or a newly indicated memory address, as desired).

In these arrangements, the display controller 14 fetches and transfers only the new (e.g. top/bottom/left/right) segments of the new frame 51 that were not present in the previous frame 50 to the display 20, e.g. using partial frame update mode.

The new data is written over the data of the previous frame 50 that is not needed for the new frame 51.

Figure 4B:
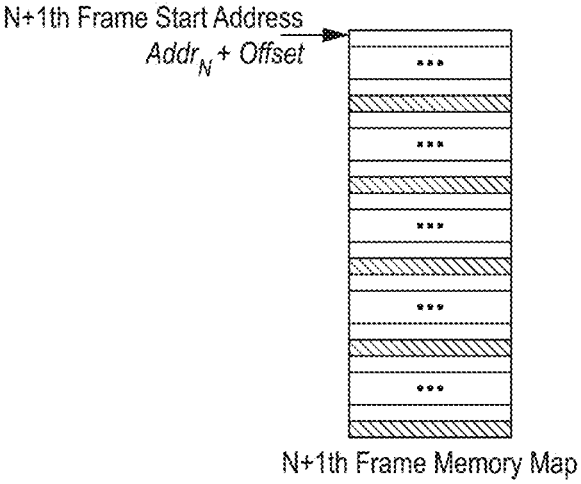
FIG. 4B shows schematically a memory map that may be used to store the current image of FIG. 3 in accordance with an embodiment of the technology described herein.

As illustrated by FIG. 4B, this means that the circular buffer operation of the display's frame buffer 25 need not be modified (apart from the starting address) in order for the new frame 51 to be read out from the buffer 25 and displayed correctly.

In this way, the display can use data provided to it by the display controller plural times in respect of plural frames. This reduces the amount of data that the display controller must provide to the display, and accordingly reduces the display interface bandwidth and power consumption and the overall memory bandwidth and power requirements of the data processing system.

Although FIG. 3 illustrates an example in which the new frame 51 is horizontally and vertically translated with respect to the previous frame 50, it would be possible for the new frame 51 to be only horizontally translated, or only vertically translated with respect to the previous frame 50. Equally, although FIG. 3 illustrates an example in which the new frame 51 is positively translated with respect to the previous frame 50, it would be possible for the new frame 51 to be negatively translated with respect to the previous frame 50.

More generally, it would be possible to use the memory address indication in accordance with the present embodiment whenever part of the new frame 51 is the same as (or sufficiently similar to) part of the previous frame 50.

In the present embodiment, the memory address offset can be determined using translation information, i.e. information indicating the amount and/or direction of translation between the previous frame 50 and the new frame 51.

In virtual reality (VR) or augmented reality (AR) applications, this information may be obtained from tracking information, e.g. from a head mounted display (HMD).

In such applications, it is typically necessary to render at high frame rates, such as 90 fps or 120 fps, which can significantly strain the GPU performance. As such, a large view/window of the scene may be rendered at a lower frame rate, e.g. at 45 fps, and as, e.g. the user's head moves, the display controller can read different parts of this large image in respect of plural different frames to be displayed.

It would, however, also be possible to implement the approach of the present embodiment using two frames rendered one after another, e.g. where the difference between the two frames is relatively small.

Various embodiments also apply to video applications, e.g. where the successive frames are video frames. In this case, it may be necessary to compare successive frames to determine information indicating the amount and/or direction of translation between the previous frame 50 and the new frame 51. This can be done by a motion-estimation engine of a video-encoder.

Although the above embodiments have been described in terms of the new frame 51 being a translated version of the previous frame 50, it would also be possible to make use of the techniques according to various embodiments when the new frame 51 is modified with respect to the previous frame 50 in one or more other ways.

For example, in virtual reality (VR) applications, lens correction filtering is applied to the image, e.g. by the display controller 14, before sending the data to the display 20. In this case, the lens correction may mean that the new frame 51 is not so simply related to the previous frame 50. However, if the displacement (e.g. head movement) is sufficiently small, most of the image data stored in display memory 25 can be reused in accordance with the present embodiment.

In these embodiments, where the displacement (e.g. head movement) is significant, then it may be preferable to update the whole frame, e.g. to ensure correct lens correction.

According to various other embodiments, the panel's frame buffer 25 may be segmented into tiles. Each tile may comprise, for example, 256×256 pixels. Each tile may be updated with image data individually by the display controller.

Figure 5:
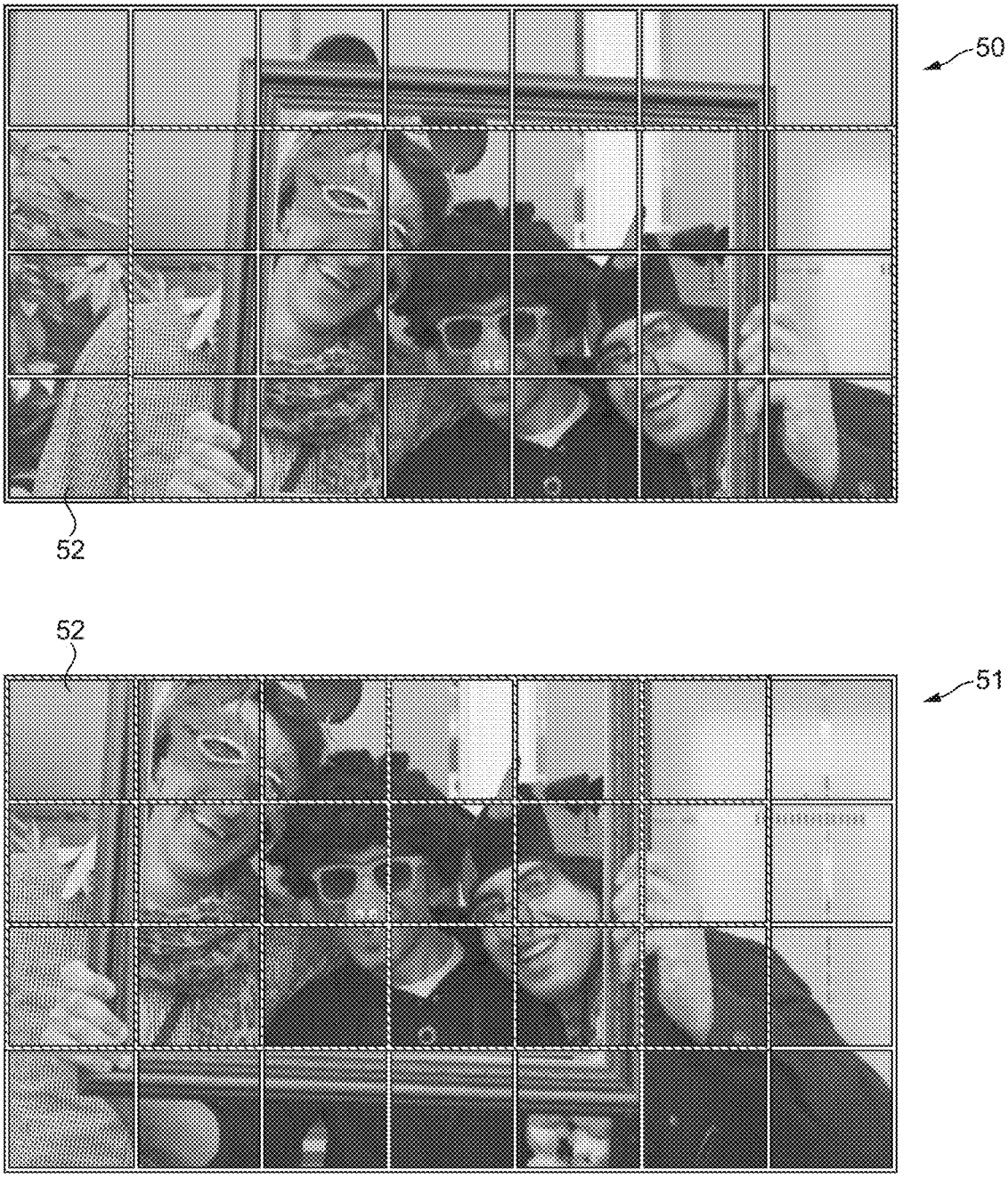
FIG. 5 shows an example of a current image and a previous image that may be provided to a display in accordance with an embodiment of the technology described herein.

This arrangement is illustrated by FIG. 5, which shows a new frame 51 and a previous frame 50. The previous frame 50 is stored in the frame buffer 25 of the display 20, which is divided into plural tiles 52.

In this case, the panel interface may support reprogramming of the base address of each tile individually, e.g. using command mode. This can allow the rearrangement of the tiles within the frame.

In these embodiments, if a small translation is detected (e.g. by the head tracker), the initial addresses of tiles that remain wholly in the new frame can be updated, thereby adjusting their spatial positions within the new frame 51.

These embodiments may be particularly beneficial where the displacement is constrained to be in units of individual tiles. In this case, the display processor will need to fetch and transfer only the updated tiles to the panel's memory, e.g. using partial frame update.

Thus, for example, in the example illustrated in FIG. 5, the new frame 51 is a horizontally and vertically translated version of the previous frame 50. As can be seen from FIG. 5, the image data for a significant number of tiles is the same between the new frame 51 and the previous frame 50. The image data for these tiles can be re-used by reprogramming the base address of each of the tiles individually. Image data for only a limited number of new tiles will need to be provided to the display 20 by the display controller 14.

Figure 6:
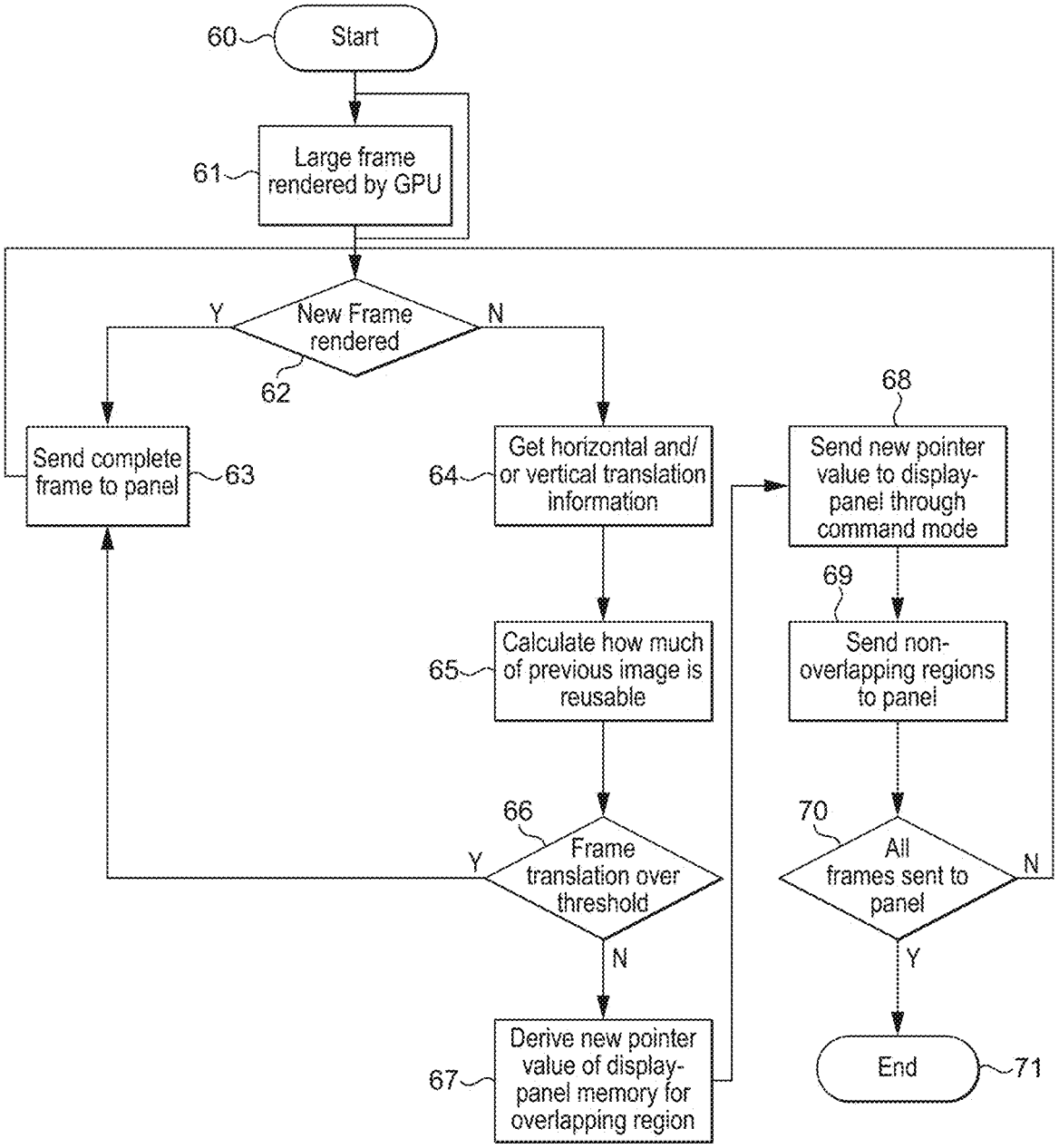
FIG. 6 illustrates schematically a method in accordance with an embodiment of the technology described herein.

FIG. 6 illustrates a process in accordance with an embodiment. The process starts at step 60. A large frame (i.e. larger than is required for display) is initially rendered by the GPU 11 (step 61) and stored in memory 40. Initially, when a new frame is rendered in this manner, data from the new frame is sent to the display 20 for display (steps 62 and 63).

The process then loops back to step 62 for the next frame to be displayed. Where it is determined at step 62 that the frame is no longer "new", translation information is obtained that indicates the amount and/or direction in which the next frame to be displayed has been horizontally and/or vertically translated with respect to the previous frame (step 64), and a determination is made as to how much of the previous frame is re-usable for the next frame (step 65).

The obtained translation information is then compared to a threshold (step 66). Where the translation is greater than the threshold, then the display controller 14 sends an entire frame of data to the display 20 (step 63). Where the translation is less than or equal to the threshold, then a new memory pointer value is determined for the memory 25 (step 67), and sent to the display (step 68), e.g. using command mode.

The display controller 14 also sends image data in respect of the new, non-overlapping regions of the new frame 51 to the display 20 (step 69), and this data is used together with the pointer to display the new frame. This process is repeated multiple times for multiple frames for display. Once it is determined that all frames have been sent to the panel (step 70), the process ends at step 71.

It will be appreciated that various embodiments allow lower system latency and bandwidth because of the reduced amount of data that is transferred between the memory 40 and the display 20. Various embodiments reduce the bandwidth on the display interface 30, which significantly reduces power use of the overall data processing system. In addition, various embodiments require a reduced amount of image processing.

It can be seen from the above that embodiments of the technology described herein enable reduction of power and memory bandwidth consumption within a data processing system. This is achieved, in embodiments at least, by a display controller indicating to a display a particular memory address for a memory of the display, and the display using the indication to control reading of data from the memory.

The foregoing detailed description has been presented for the purposes of illustration and description. It is not intended to be exhaustive or to limit the technology to the precise form disclosed. Many modifications and variations are possible in the light of the above teaching. The described embodiments were chosen in order to best explain the principles of the technology and its practical application, to thereby enable others skilled in the art to best utilise the technology in various embodiments and with various modifications as are suited to the particular use contemplated. It is intended that the scope be defined by the claims appended hereto.

What is claimed is:

1. A method of operating a data processing system that comprises a display and a display controller operable to provide data to the display for an output surface to be displayed; wherein the display comprises:

a screen operable to display the output surface;

a memory operable to store data provided to the display by the display controller for the output surface to be displayed on the screen; and output circuitry operable to read output surface data from the memory of the display and to provide the read output surface data to the screen to display the output surface;

the method comprising:

the display controller providing to the display data for the output surface to be displayed;

the display storing the output surface data provided to the display by the display controller in the memory of the display; and the output circuitry of the display reading output surface data from the memory of the display and providing the read output surface data to the screen to display the output surface;

the method further comprising:

the display controller indicating to the display a particular memory address of the memory of the display that the reading of output surface data stored in the memory of the display is to begin from; and the output circuitry of the display reading output surface data from the memory of the display beginning with the particular memory address indicated by the display controller and providing the output surface data read beginning with the particular memory address to the screen to display the output surface.

2. The method of claim 1, wherein the method comprises:

the output circuitry of the display reading all of the output surface data stored in the memory of the display beginning with the particular memory address indicated by the display controller and providing all of the output surface data read beginning with the particular memory address to the screen to display the output surface.

3. The method of claim 1, wherein the method comprises the output circuitry of the display reading all of the output surface data stored in the memory of the display beginning with the particular memory address indicated by the display controller by:

reading data from the memory of the display beginning with the particular memory address indicated by the display controller, continuing in memory address order to the last memory address of the memory of the display, then continuing from the first memory address of the memory of the display in memory address order to the memory address of the memory of the display that immediately precedes the particular memory address indicated by the display controller; or reading data from the memory of the display beginning with the particular memory address indicated by the display controller, continuing in reverse memory address order to the first memory address of the memory of the display, then continuing from the last memory address of the memory of the display in reverse memory address order to the memory address of the memory of the display that immediately follows the particular memory address indicated by the display controller;

the method further comprising the output circuitry of the display providing all of the output surface data read beginning with the particular memory address to the screen to display the output surface.

4. The method of claim 1, wherein the output surface is related to a previous version of the output surface by a horizontal and/or vertical translation, and wherein the method further comprises:

obtaining translation information indicating a degree to which and/or a direction in which the output surface has been translated with respect to the previous version of the output surface;

determining the particular memory address using the translation information;

the display controller indicating to the display the particular memory address determined using the translation information;

the display controller providing to the display output surface data for one or more regions of the output surface that other than overlap with the previous version of the output surface;

the display storing the output surface data for the one or more regions of the output surface that other than overlap with the previous version of the output surface in the memory of the display; and the output circuitry of the display reading output surface data from the memory of the display beginning with the particular memory address determined using the translation information.

5. The method of claim 4, further comprising obtaining the translation information from head tracking information from a head mounted display device.

6. The method of claim 4, further comprising:

a host processor controlling a frame generator to generate the output surface data; and obtaining the translation information from the frame generator and/or the host processor.

7. The method of claim 4, further comprising obtaining the translation information by comparing the output surface to the previous version of the output surface.

8. The method of claim 4, comprising the display storing the output surface data for the one or more regions of the output surface that other than overlap with the previous version of the output surface in the memory of the display by writing over data for one or more regions of the previous version of the output surface that are other than present in the output surface due to the translation.

9. The method of claim 1, wherein the method comprises:

the display controller providing to the display data for one or more sub-regions of the output surface; and the display storing the output surface data in the memory of the display by writing over data for one or more sub-regions of a previous version of the output surface.

10. A data processing system comprising:

a display; and a display controller operable to provide to the display data for an output surface to be displayed;

wherein the display comprises:

a screen operable to display the output surface;

a memory operable to store data provided to the display by the display controller for the output surface to be displayed on the screen; and output circuitry operable to read output surface data from the memory of the display and to provide the read output surface data to the screen to display the output surface;

wherein the display controller is operable to indicate to the display a particular memory address of the memory of the display that the reading of output surface data stored in the memory of the display is to begin from; and wherein the output circuitry of the display is operable to read output surface data from the memory of the display beginning with the particular memory address indicated by the display controller, and to provide the output surface data read beginning with the particular memory address to the screen to display the output surface.

11. The data processing system of claim 10, wherein:

the output circuitry of the display is operable to read all of the output surface data stored in the memory of the display beginning with the particular memory address indicated by the display controller and to provide all of the output surface data read beginning with the particular memory address to the screen to display the output surface.

12. The data processing system of claim 10, wherein:

the output circuitry of the display is operable to read all of the output surface data stored in the memory of the display beginning with the particular memory address indicated by the display controller by:

reading data from the memory of the display beginning with the particular memory address indicated by the display controller, continuing in memory address order to the last memory address of the memory of the display, then continuing from the first memory address of the memory of the display in memory address order to the memory address of the memory of the display that immediately precedes the particular memory address indicated by the display controller; or reading data from the memory of the display beginning with the particular memory address indicated by the display controller, continuing in reverse memory address order to the first memory address of the memory of the display, then continuing from the last memory address of the memory of the display in reverse memory address order to the memory address of the memory of the display that immediately follows the particular memory address indicated by the display controller;

wherein the output circuitry of the display is further operable to provide all of the output surface data read beginning with the particular memory address to the screen to display the output surface.

13. The data processing system of claim 10, wherein the output surface is related to a previous version of the output surface by a horizontal and/or vertical translation, and wherein the data processing system is operable to:

obtain translation information indicating a degree to which and/or a direction in which the output surface has been translated with respect to the previous version of the output surface; and determine the particular memory address using the translation information;

wherein the display controller is operable to indicate to the display the particular memory address determined using the translation information;

the display controller is operable to provide to the display output surface data for one or more regions of the output surface that other than overlap with the previous version of the output surface;

the display is operable to store the output surface data for the one or more regions of the output surface that other than overlap with the previous version of the output surface in the memory of the display; and the output circuitry of the display is operable to read output surface data from the memory of the display beginning with the particular memory address determined using the translation information.

14. The data processing system of claim 13, further comprising a head mounted display device, wherein the data processing system is operable to obtain the translation information from head tracking information from the head mounted display device.

15. The data processing system of claim 13, further comprising a host processor and/or a frame generator, wherein the data processing system is operable to obtain the translation information from the frame generator and/or the host processor.

16. The data processing system of claim 13, wherein the data processing system is operable to obtain the translation information by comparing the output surface to the previous version of the output surface.

17. The data processing system of claim 10, wherein:

the display controller is operable to provide to the display data for one or more sub-regions of the output surface; and the display is operable to store the output surface data in the memory of the display by writing over data for one or more sub-regions of a previous version of the output surface.

18. A non-transitory computer readable storage medium storing computer software code which when executing on a processor performs a method of operating a data processing system that comprises a display and a display controller operable to provide data to the display for an output surface to be displayed; wherein the display comprises:

a screen operable to display the output surface;

a memory operable to store data provided to the display by the display controller for the output surface to be displayed on the screen; and output circuitry operable to read output surface data from the memory of the display and to provide the read output surface data to the screen to display the output surface;

the method comprising:

the display controller providing to the display data for the output surface to be displayed;

the display storing the output surface data provided to the display by the display controller in the memory of the display; and the output circuitry of the display reading output surface data from the memory and providing the read output surface data to the screen to display the output surface;

the method further comprising:

the display controller indicating to the display a particular memory address of the memory of the display that the reading of output surface data stored in the memory of the display is to begin from; and the output circuitry of the display reading output surface data from the memory of the display beginning with the particular memory address indicated by the display controller, and providing the output surface data read beginning with the particular memory address to the screen to display the output surface.

* * * * *